US006351921B1

(12) United States Patent
Roberson

(10) Patent No.: US 6,351,921 B1
(45) Date of Patent: Mar. 5, 2002

(54) SIDING AND PORCH CEILING ATTACHMENT SYSTEM

(75) Inventor: James M. Roberson, Jacksonville, FL (US)

(73) Assignee: Straight Track Lock Systems, Inc., Jacksonville, FL (US)

( * ) Notice: Subject to any disclaimer, the term of this patent is extended or adjusted under 35 U.S.C. 154(b) by 0 days.

(21) Appl. No.: 09/528,463

(22) Filed: Mar. 17, 2000

Related U.S. Application Data

(60) Provisional application No. 60/154,934, filed on Sep. 21, 1999.

(51) Int. Cl.[7] ..... E04D 1/00

(52) U.S. Cl. ..... 52/521; 52/543; 52/506.1; 52/712

(58) Field of Search ..... 52/551, 553, 531, 52/547, 543, 521, 520, 525, 526, 552, 522, 529, 544, 719, 699, 700, 703, 506.1

(56) References Cited

U.S. PATENT DOCUMENTS 5,150,555 A * 9/1992 Wood ..... 52/544
5,575,127 A * 11/1996 O'Neal ..... 52/520

* cited by examiner

*Primary Examiner*—Carl D. Friedman
*Assistant Examiner*—Naoko Slack
(74) *Attorney, Agent, or Firm*—Steven R. Scott

(57) ABSTRACT

A mounting rail for siding and ceiling members featuring a locking member to maintain siding and ceiling members on the mounting rail. The mounting rail has (i) a siding support member having a horizontal leg extending forwardly with a vertical leg extending downwardly from its front edge as is typical in the art, (ii) a web member extending upwardly from the back edge of said horizontal leg, and (iii) a siding maintenance member extending forwardly and downwardly from the upper edge of the web member.

12 Claims, 6 Drawing Sheets

SIDING AND PORCH CEILING ATTACHMENT SYSTEM

This application claims benefit of provisional application 60/154,934 filed Sep. 21, 1999.

BACKGROUND

1. Field of the Invention

This invention relates generally to the field of vinyl and metal siding for attachment to the side of buildings. More specifically, it relates to bracket or rail systems for the mounting and retention of said siding. In particular, it deals with a novel design for an attachment rail incorporating a locking member or portion to aid in the retention of a section of siding mounted/hung thereon while simultaneously providing support and helping to maintain the shape of the overlapping section of siding terminating at said rail. The features of the invention also allow it to be used for attachment of ceiling members as well as siding members.

2. Prior Art in the Field

Metal and plastic siding members are generally planar in configuration and are typically formed with a bottom portion bent inwardly and then upwardly to form a longitudinal channel with a vertical planar "leg." The top portion of each panel member is typically formed with a longitudinal lip projecting out and then down so as to correspond to the channel running along the bottom of the panel member positioned above. A securement flange extends above the longitudinal lip of each panel. Panel members are typically secured to a wall along their top portions utilizing fasteners extending through the securement flange extending along the top of each panel. The overall system appears, upon a cursory review, to be simple and efficient with little need for improvement. However, the appearance of the finished siding is dependent upon the regularity of the substrate to which it is fastened. Most siding members are flexible, and tend to conform to the substrate on which they are mounted. Thus, as the underlying substrate/wall settles, or the surfacing members comprising same warp, or when (due to inherent defects) it is already possessed of undesirable asymmetries, the siding attached to the wall will become irregular, distorted and unattractive. In order to overcome these tendencies it is desirable to provide a linear mounting rail or bracket which can be fastened to the side of a building surface to be covered and provides a more stable substrate for the siding members attached thereto. An example of such a linear mounting rail can be seen in U.S. Pat. No. 5,575,127 issued to O'Neal in 1996. Such rails often feature a leg member that extends outwardly and then downwardly so as to generally conform to, and be capable of insertion into, the longitudinal lip extending along the upper portion of each siding member below the securement flange. (See, e.g., "shoulder 43" having "horizontal leg 50" and "vertical leg 51" in U.S. Pat. No. 5,575,127). However, such rails are, themselves, far from perfected. One problem that often arises grows out of the method in which such rails are used. It is advantageous when using rails of this type to mount a siding member thereon and then to fasten siding member and rail to the substrate simultaneously. Siding members often slip or fall from current art rail members prior to the completion of this process, greatly exacerbating the difficulty of utilizing such rail members and of installing siding. This results in the need to invest increased time/labor in the installation process with a consequent increase in costs and a reduction of profitability for the contractor/builder.

SUMMARY AND OBJECTS OF THE INVENTION

It is the purpose of this invention to provide a mounting rail for siding members that is simple and efficient to use, and possesses means for maintaining siding members hung thereon in place once rail and siding member are joined together via insertion of the rail's leg member into the longitudinal lip running along the top of the rail member. It is a further purpose of this invention to improve the attractiveness of the siding mounted thereon by simultaneously providing means for supporting and maintaining the shape of the bottom portion of the siding member mounted above the rail. Finally it is a purpose of this invention to provide the foregoing features in a locking portion of the rail member that forms an integral part and extension of the generally planar material forming said rail member. The foregoing features are provided in a rail member having: (1) A downwardly extending leg or shoulder member extending longitudinally along its lower edge; (2) a upwardly extending flange extending longitudinally along its upper edge; and (3) intermediate said leg and flange, a longitudinally extending portion of said rail that extends out and down, then back and up so as to form an intermediate locking member capable of hooking or holding in place the upward flange of a siding member mounted on said downwardly extending leg or shoulder member.

DETAILED DESCRIPTION OF THE PREFERRED EMBODIMENT

Figure 1:
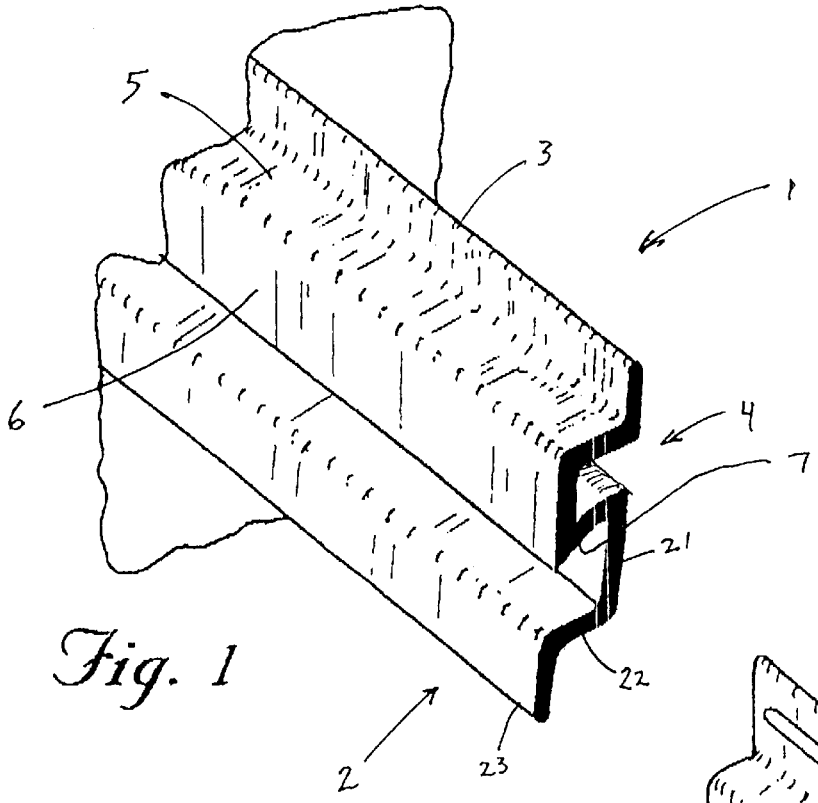
FIG. 1 provides a perspective view of a portion of a first embodiment of a rail member produced in accordance with the teachings of this invention.
Figure 2:
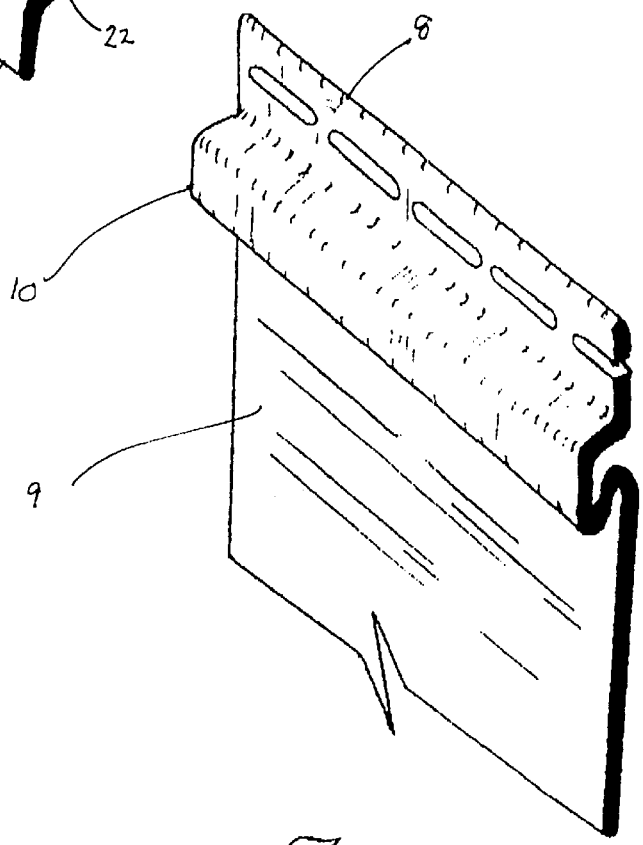
FIG. 2 provides a perspective view of a portion of a siding member aligned for insertion into the rail member illustrated in FIG. 1.

As will be noted from review of the drawing figures, the mounting rail (denoted generally by arrow 1) of the current invention is provided with: (1) a mounting shoulder (denoted generally by arrow 2) having [a] a generally vertical upper portion 21, [b] a generally horizontal middle portion 22, and [c] a generally vertical lower portion 23; and (2) an upwardly extending flange 3. The foregoing features are not atypical in prior art devices. However, it is also provided with a novel locking member or means (denoted generally by arrow 4) intermediate these two basic elements. The locking member 4 may advantageously be formed as an integral portion of the planar material forming mounting rail 1 and is so shown in two of the configurations illustrated.

Figure 3:
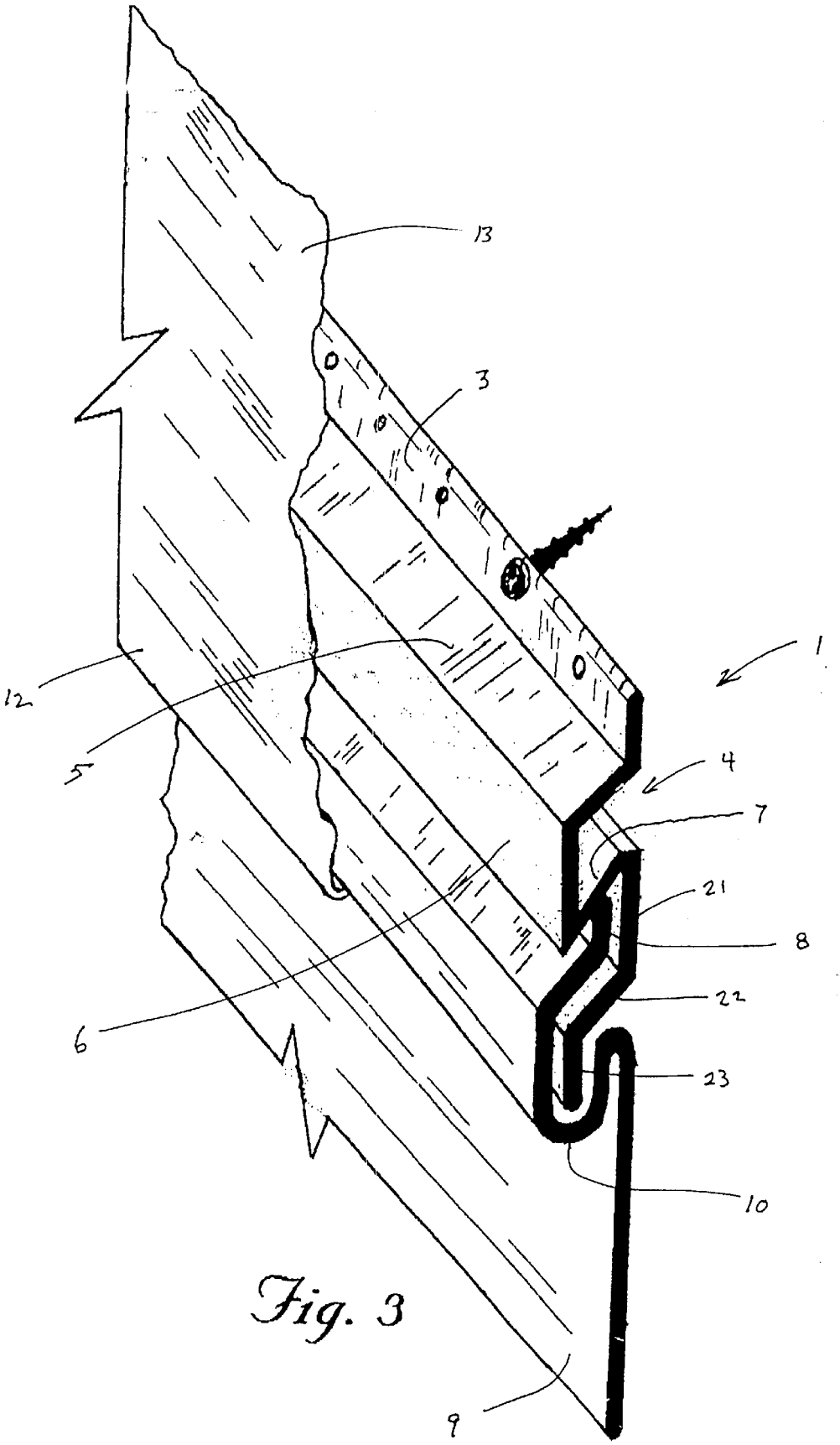
FIG. 3 provides a perspective view of a portion of said first embodiment of a rail member produced in accordance with the teachings of this invention joined to an upper siding member and a lower siding member in accordance with the teachings of this invention.
Figure 4:
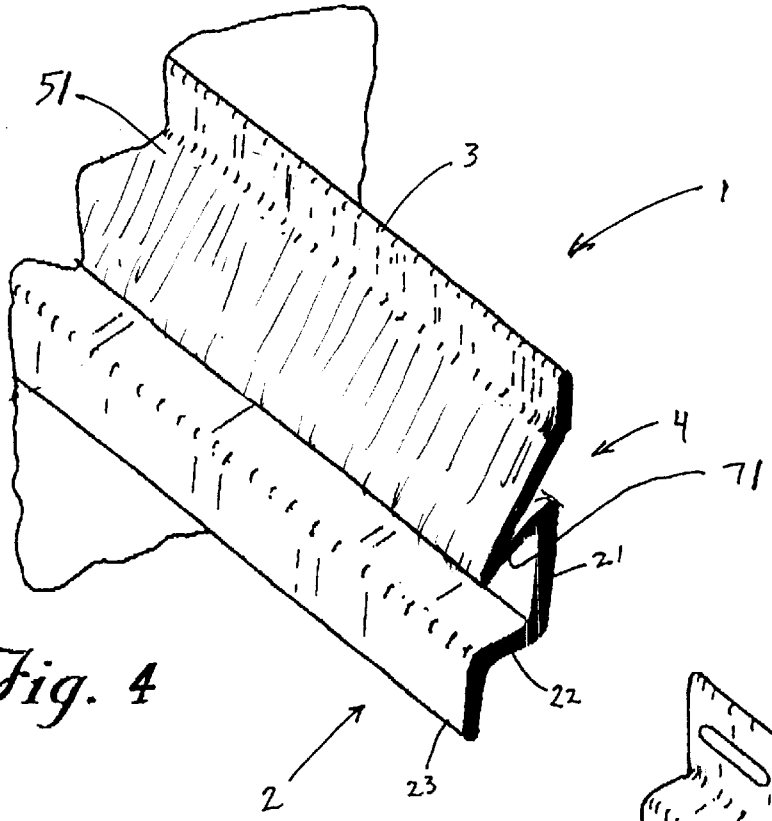
FIG. 4 provides a perspective view of a portion of a second embodiment of a rail member produced in accordance with the teachings of this invention.
Figure 5:
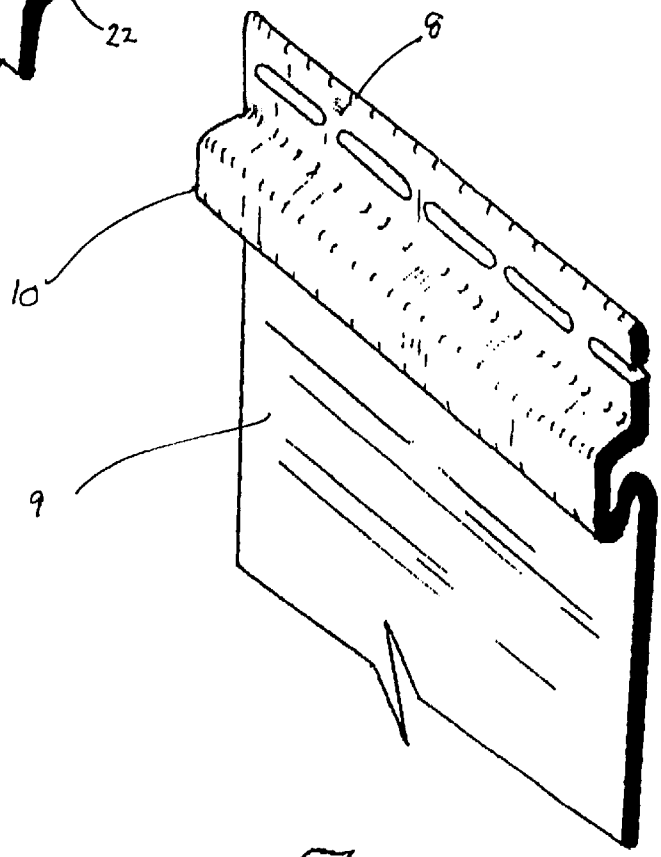
FIG. 5 provides a perspective view of a portion of a siding member aligned for insertion into the rail member illustrated in FIG. 4.
Figure 6:
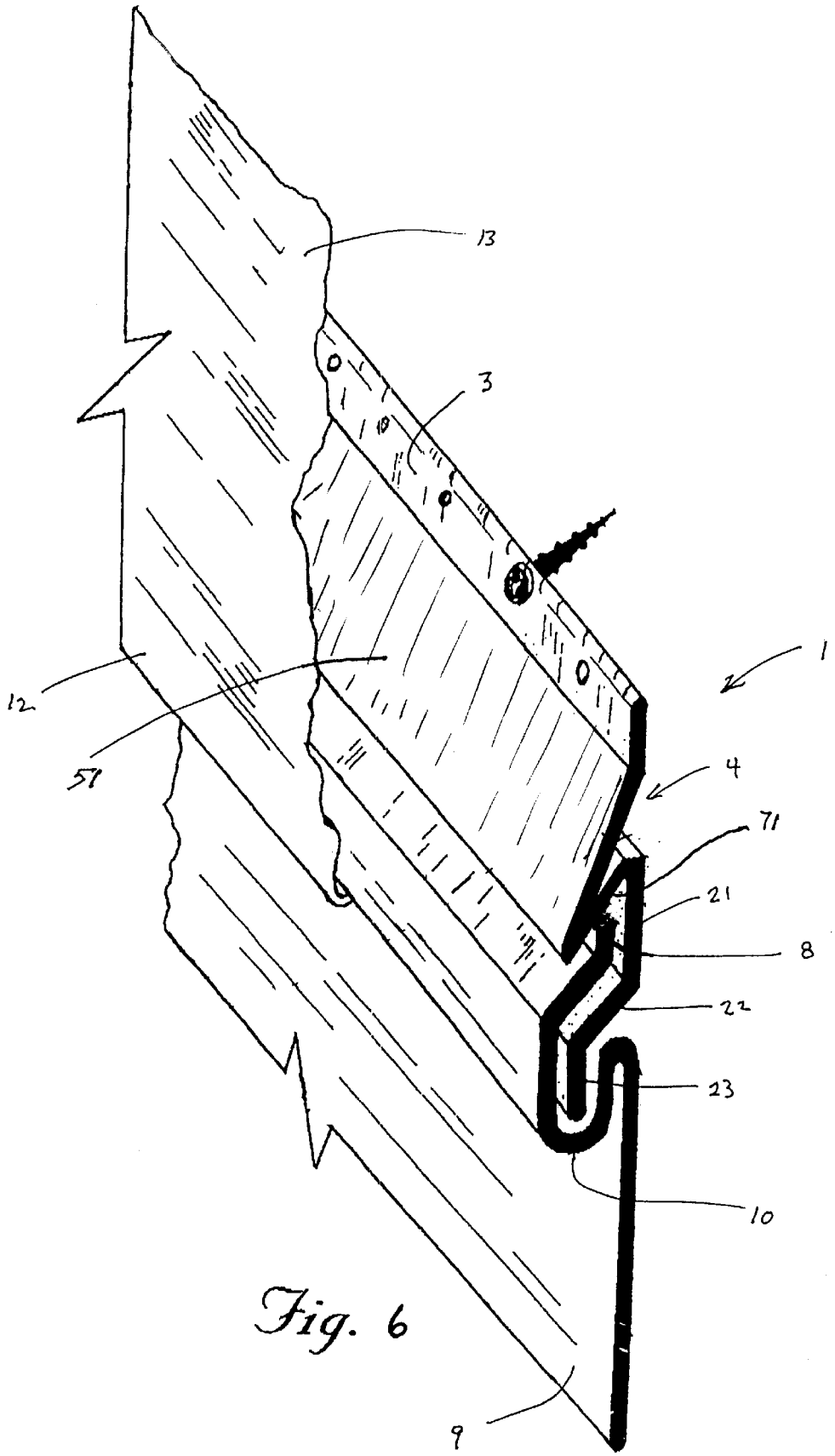
FIG. 6 provides a perspective view of a portion of said second embodiment of a rail member produced in accordance with the teachings of this invention joined to an upper siding member and a lower siding member in accordance with the teachings of this invention.

When so formed, it may assume the form illustrated in FIGS. 1 and 3, with an upper extension 5 that protrudes outwardly from the mounting rail 1, a downward extension 6 that is generally parallel to the flange 3 of mounting rail 1, and a lower extension 7 that extends up and back to the top portion 21 of mounting shoulder 2. However, the simpler configuration illustrated in FIGS. 4 and 6 is preferred. In this embodiment a single front extension 51 extends out and down and a single back extension 71 extends back up and back to the top portion 21 of mounting shoulder 2. As further illustrated in FIG. 3 and 6, the locking member 4 of the embodiments illustrated provide means for locking or holding the securement flange 8 of lower siding member 9 in position, thereby preventing longitudinal lip 10 of the siding member from slipping off of shoulder 2. It should also be noted that downward extensions and front extensions of locking member 4 also provide means for reinforcing and supporting the bottom portion 12 of upper siding member 13.

Figure 7:
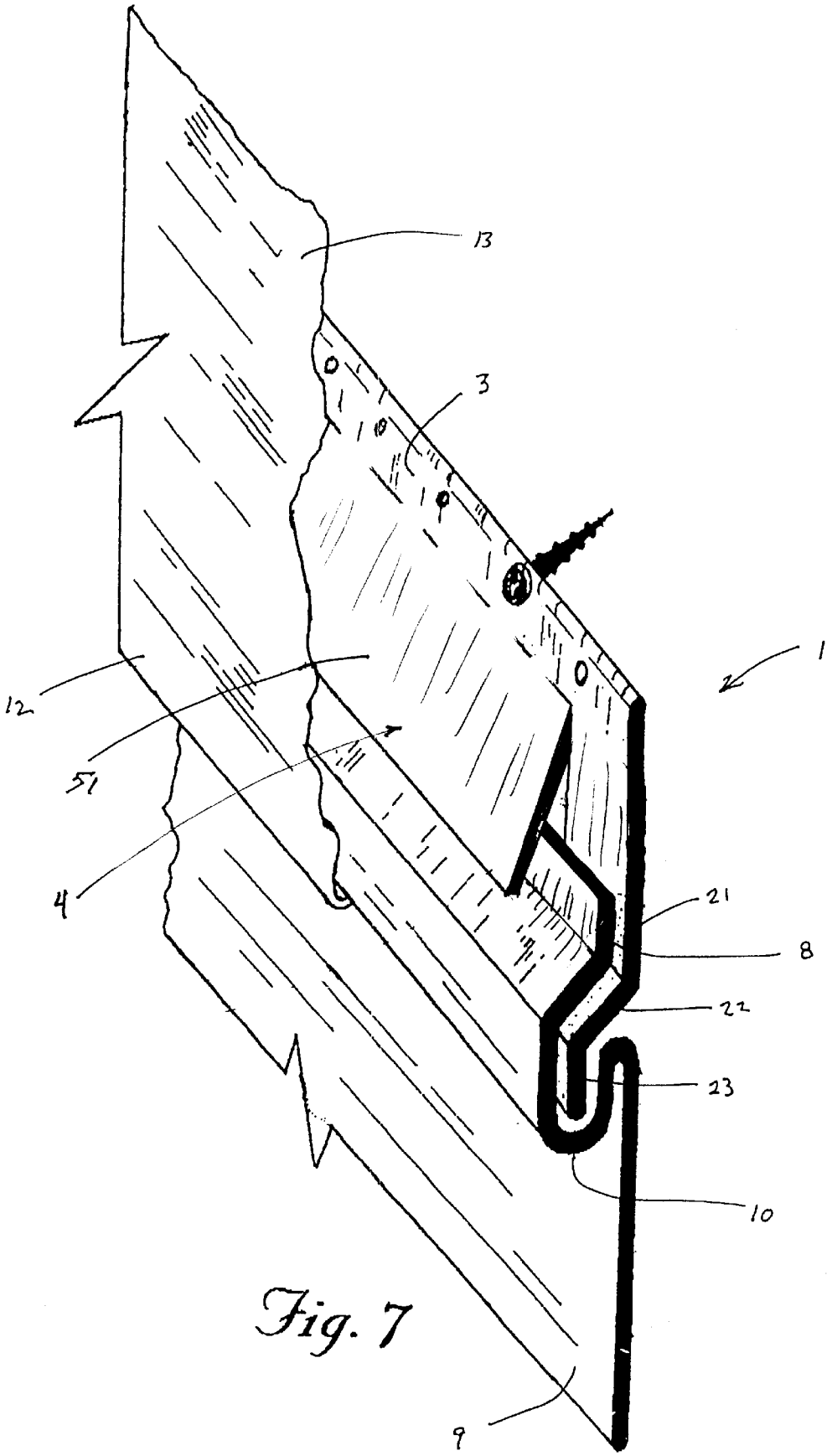
FIG. 7 provides a perspective view of a portion of a third embodiment of a rail member produced in accordance with the teachings of this invention.
Figure 8:
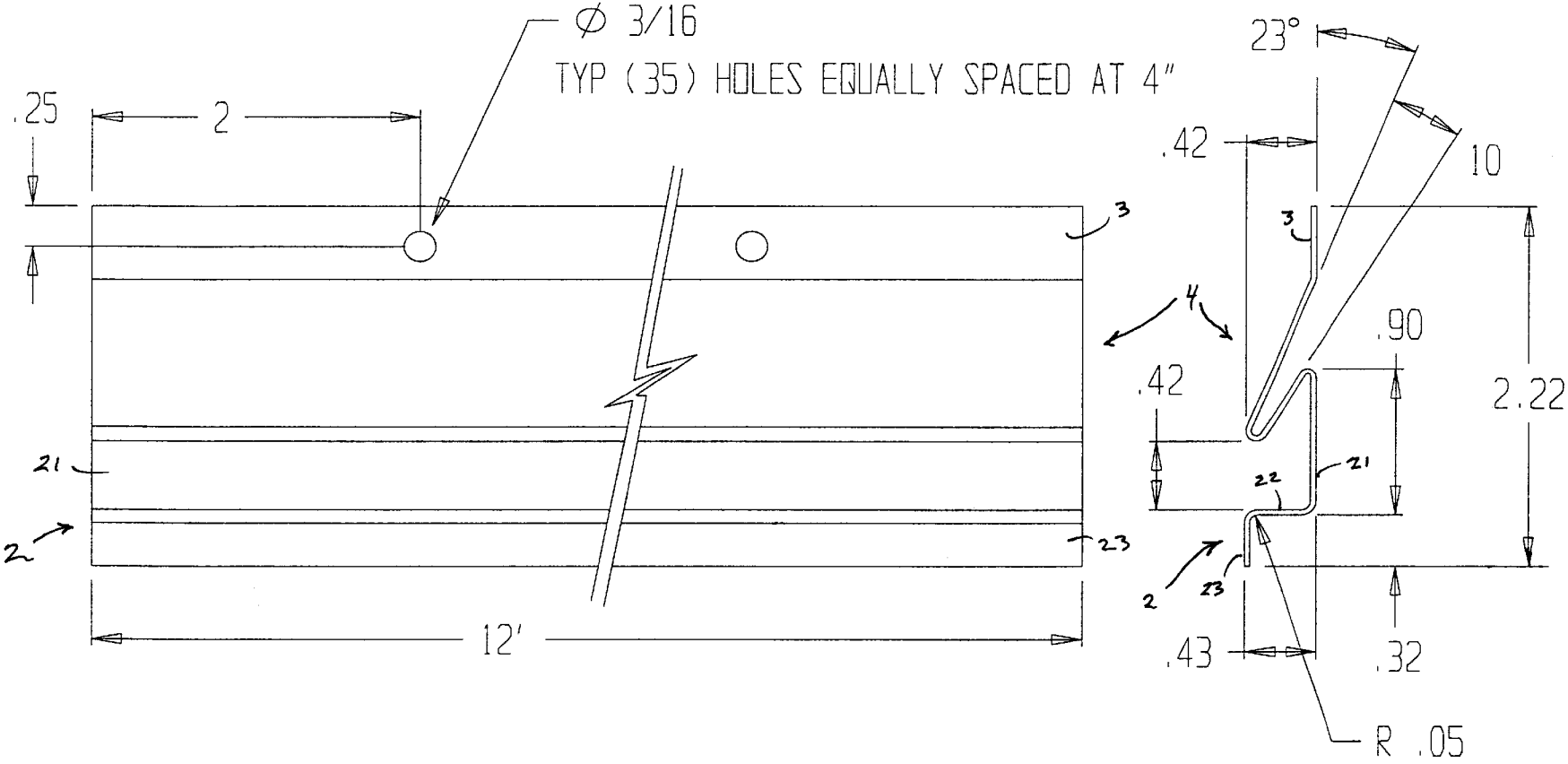
FIG. 8 provides additional construction details of the invention as applied to the second embodiment illustrated in FIGS. 4 and 6.

It would also be possible to produce a system in accordance with the teachings of this invention where, instead of bending a single member so as to form a locking member 4 as an integral part thereof, that such an element could be fastened thereto as a separate member. Likewise, a locking member could be formed by periodically punching and bending sections of the flange 3 into an appropriate configuration as illustrated in FIG. 7. The invention can also be used to mount ceiling members and can be used as furring strips on concrete blocks and other materials. From the foregoing it will be obvious that numerous variations are possible without exceeding the ambit of the inventive concept as further and more specifically defined in the claims that follow.

I claim:

1. A siding attachment system, comprising:

a. A generally vertically extending intermediate web having an upper edge and a lower edge;

b. a siding support shoulder including a horizontal leg and a vertical leg, said horizontal leg connected to the lower edge of said intermediate web at a first end, extending forwardly from said web and ending at a distal end, said vertical leg extending downwardly from said distal end of said horizontal leg;

c. a siding maintenance member extending forwardly and downwardly from the upper edge of said intermediate web, said member being formed by bending forward a portion of the intermediate web; and d. a generally vertically extending upper web having a top edge and a bottom edge, which bottom edge is attached to the siding maintenance member.

2. A siding attachment system, as described in claim 1 wherein a plurality of holes are formed in said intermediate web, said holes extending across said intermediate web in linear alignment and sized for insertion of a fastener therethrough for securing said intermediate web to a wall.

3. A siding attachment system, as described in claim 1 wherein a plurality of slots are formed in said upper web, said slots extending across said upper web in linear alignment and sized for insertion of a fastener therethrough for securing said upper web to a wall.

4. A siding attachment system, as described in claim 1 wherein a plurality of slots are formed in said intermediate web, said slots extending across said intermediate web in linear alignment and sized for insertion of a fastener therethrough for securing said intermediate web to a wall.

5. A siding attachment system, comprising:

a. A generally vertically extending intermediate web having an upper edge and a lower edge;

b. a siding support shoulder including a horizontal leg and a vertical leg, said horizontal leg connected to the lower edge of said intermediate web at a first end, extending forwardly from said web and ending at a distal end, said vertical leg extending downwardly from said distal end of said horizontal leg;

c. a siding maintenance member extending forwardly and downwardly from the upper edge of said intermediate web, said siding maintenance member is comprised of a front extension extending outwardly and downwardly from the bottom edge of said upper web and ending at a distal end and a back extension extending from said distal end back to the upper edge of the intermediate web; and d. a generally vertically extending upper web having a top edge and a bottom edge, which bottom edge is attached to the siding maintenance member.

6. A siding attachment system, as described in claim 5 wherein a plurality of holes are formed in said upper web, said holes extending across said upper web in linear alignment and sized for insertion of a fastener therethrough for securing said upper web to a wall.

7. A siding attachment system, as described in claim 6 wherein a plurality of slots are formed in said upper web, said slots extending across said upper web in linear alignment and sized for insertion of a fastener therethrough for securing said upper web to a wall.

8. A siding attachment system, as described in claim 5 wherein a plurality of slots are formed in said upper web, said slots extending across said upper web in linear alignment and sized for insertion of a fastener therethrough for securing said upper web to a wall.

9. A siding attachment system, comprising:

a. A generally vertically extending intermediate web having an upper edge and a lower edge;

b. a siding support shoulder including a horizontal leg and a vertical leg, said horizontal leg connected to the lower edge of said intermediate web at a first end, extending forwardly from said web and ending at a distal end, said vertical leg extending downwardly from said distal end of said horizontal leg;

c. a siding maintenance member extending forwardly and downwardly from the upper edge of said intermediate web, said siding maintenance member is comprised of an upper extension extending outwardly from the bottom edge of said upper web and ending at a distal end, a downward extension extending from said distal end to a lower end, and an inward extension extending inwardly from said lower end back to the upper edge of the intermediate web; and d. a generally vertically extending upper web having a top edge and a bottom edge, which bottom edge is attached to the siding maintenance member.

10. A siding attachment system, as described in claim 9 wherein a plurality of holes are formed in said upper web, said holes extending across said upper web in linear alignment and sized for insertion of a fastener therethrough for securing said upper web to a wall.

11. A siding attachment system, as described in claim 10 wherein a plurality of slots are formed in said upper web, said slots extending across said upper web in linear alignment and sized for insertion of a fastener therethrough for securing said upper web to a wall.

12. A siding attachment system, as described in claim 9 wherein a plurality of slots are formed in said upper web, said slots extending across said upper web in linear alignment and sized for insertion of a fastener therethrough for securing said upper web to a wall.

* * * * *